US006457272B1

(12) United States Patent
Weinraub

(10) Patent No.: US 6,457,272 B1
(45) Date of Patent: Oct. 1, 2002

(54) FIREARM SECURITY ARRANGEMENT

(75) Inventor: Adam S. Weinraub, Orange, CA (US)

(73) Assignee: Weinraub Enterprises, Inc., Orange, CA (US)

( * ) Notice: Subject to any disclaimer, the term of this patent is extended or adjusted under 35 U.S.C. 154(b) by 0 days.

(21) Appl. No.: 09/871,753

(22) Filed: Jun. 1, 2001

(51) Int. Cl.[7] ..... F41A 17/54
(52) U.S. Cl. ..... 42/70.07
(58) Field of Search ..... 42/70.06, 70.07

(56) References Cited

U.S. PATENT DOCUMENTS

| | | | | |
|---|---|---|---|---|
| 2,664,658 A | | 1/1954 | Bjorklund | |
| 3,392,471 A | | 7/1968 | Foote | |
| 3,616,559 A | | 11/1971 | Sobolewski | |
| 3,624,945 A | | 12/1971 | Foote | |
| 3,732,641 A | * | 5/1973 | Adajian | 42/70.07 |
| 3,956,842 A | | 5/1976 | Ballenger | |
| 4,030,221 A | | 6/1977 | Doobenen et al. | |
| 4,499,681 A | | 2/1985 | Bako et al. | |
| 4,509,281 A | | 4/1985 | Dreiling et al. | |
| 4,616,493 A | | 10/1986 | Fazzolari et al. | |
| 4,646,547 A | | 3/1987 | Scelba et al. | |
| 5,153,360 A | | 10/1992 | Upton | |
| 5,191,158 A | | 3/1993 | Fuller et al. | |
| 5,255,544 A | | 10/1993 | Wu | |
| 5,392,552 A | | 2/1995 | McCarthy et al. | |
| 5,400,538 A | | 3/1995 | Shannon | |
| 5,419,068 A | * | 5/1995 | Pages et al. | 42/70.07 |
| 5,437,119 A | | 8/1995 | Womack | |
| 5,487,234 A | | 1/1996 | Dragon | |
| 5,515,633 A | | 5/1996 | Harris | |
| 5,535,605 A | | 7/1996 | Werner | |
| 5,544,440 A | | 8/1996 | Stockman | |
| 5,572,889 A | | 11/1996 | Ping-Hua | |
| 5,638,627 A | | 6/1997 | Klein et al. | |
| 5,647,158 A | * | 7/1997 | Eskelinen et al. | 42/70.07 |
| 5,720,193 A | * | 2/1998 | Dick | 70/268 |
| 5,832,647 A | * | 11/1998 | Ling et al. | 42/70.07 |
| 5,899,102 A | | 5/1999 | Ling | |
| 5,918,402 A | | 7/1999 | Weinraub | |
| 6,009,654 A | * | 1/2000 | Williams et al. | 42/70.11 |

FOREIGN PATENT DOCUMENTS

| | | | | |
|---|---|---|---|---|
| GB | 968669 | * | 9/1964 | 42/70.07 |
| GB | 1290330 | * | 9/1972 | 42/70.07 |

OTHER PUBLICATIONS

Pro–Lok Advertising brochure. Exhibit A, 4 pages, no date.
Pro–Lok Advertising brochure, Exhibit B, 4 pages, no date.
One page flyer illustrating a cable lock arrangement for guns, Project Homesafe, no date.
U.S. patent application Ser. No. 09/593,533, Weinrub, filed Jun. 14, 2000, pending.

* cited by examiner

*Primary Examiner*—Stephen M. Johnson
(74) *Attorney, Agent, or Firm*—Harold L. Jackson

(57) ABSTRACT

Firearm security arrangements are disclosed that may be incorporated or provided as an add-on elements to a variety of gun locks. The lock may be toughened by adding hardened inserts to strategic locations on the gun lock. Additionally, hardening may be accomplished by a plurality of pins located in the gun lock side members. Fitting plates or escutcheon plates may be directly incorporated into gun lock upon manufacture or provided as a kit part. Additional security is provided by a cable with end caps. The cable is looped through the barrel of a gun and the end caps secured to the gun lock.

26 Claims, 6 Drawing Sheets

10
11
12

18
19
20

14B
14A
14
16
16
15A
15

23
24
25
26
21
28
22
22A
22B
27

80
32
37
82
92
94
96

35
33
37
30
31
84

30
86

70
81
32
30
72
40
44
52
56
34

88
32
88
30
36

32
33
37
35
88
h
l 30
82
32
83
85
81
44
83
31
82
56
31

32
89

FIREARM SECURITY ARRANGEMENT

FIELD OF THE INVENTION

This invention relates generally to firearm safety lock devices, and more particularly, to gun lock hardening arrangements for making such locks more resistant to tampering or disabling by unauthorized persons.

BACKGROUND OF THE INVENTION

Thousand of handguns, shotguns and rifles are purchased every year by citizens for use in sporting events, such as hunting or trap and skeet shooting, or for use in home protection. Typically, guns are stored at one's home or apartment in drawers, closets or even under the bed. While a minority of gun owners have gun safes to store their guns, most guns owners store their guns in unlocked areas of the home accessible to others dwelling there. As such, guns provide a danger to children or adolescents whose curiosity may lead them to find and play with a gun. Additionally, a child finding a firearm may take it to show friends or take it to school. While adults may believe that guns are safely put away, children and adolescents always seem to find them, and as a result, fatalities and injuries resulting from the accidental discharge of firearms, particularly by children, has become problematic. Also the intentional use of guns by children against classmates and teachers in schools has been increasing over the last several years. Suicides by use of firearms are also at an alarming rate. In response to the rise of this danger, the US Congress and many state legislative bodies throughout the country have enacted or are in the process of enacting legislation requiring that each new purchase of a gun be accompanied by the purchase of a suitable lock. Additionally, states are creating strict requirements that gun locks must pass to resist tampering and attacks that could disable or remove a gun lock. This is in part a response to the large number of commercially available locks that are of poor quality and unreliable, and the material used to construct certain gun trigger guards that can be easily compromised, allowing the removal of the gun lock.

Conventional gun locking devices typically have two sides which clamp around the trigger guard of the gun to prevent access to the trigger, such as the devices shown in U.S. Pat. No. 5,191,158 "Trigger Guard for a Firearm", U.S. Pat. No. 4,499,681 "Security Device for Firearms", U.S. Pat. No. 4,509,281 "Gun Trigger Lock", U.S. Pat. No. 3,956,842 "Gun Trigger Lock",and U.S. Pat. No. 3,624,945 "Universal Self-Conforming Trigger Lock for Firearms". Other conventional gun locking devices are designed to immobilize the trigger as illustrated in U.S. Pat. No. 5,153,360 "Gun Lock". Some gun lock devices have been developed without key locking arrangements to allow quick access to the gun by adults but rendered safe against children who may gain access to the gun, such as disclosed in U.S. Pat. No. 4,030,221 "Gun Lock Using Manual Pressure" and U.S. Pat. No. 5,437,119 "Gun Trigger Blocking Structure" assigned to the assignee of the present invention.

Other more complex structural gun lock arrangements are shown in U.S. Pat. Nos. 3,624,945 and 4,499,681. U.S. Pat. No. 3,624,945 discloses a trigger lock with two complementary side elements which are compressed together around the gun trigger guard by a complex internal ratchet lever locking mechanism in the locking assemblage. The side elements carry a plurality of spaced-apart yieldable plungers in proximity to the trigger and guard to prevent shifting or movement of the lock assembly. U.S. Pat. No. 4,499,681 discloses a fire arm security device with a pair of opposed trigger guard covers, one of the covers having an elongate protruding housing containing a latching portion of a latch member and the other cover formed with an opening in which is disposed a catch member adapted to engage and retain the latching portion when the covers are pressed together. The latch member may be moved out of engagement with the catch member to release the covers by means of a manual actuator which is controlled by a combination lock contained in the cover.

Many of these above-described prior art gun locking devices are limited to accidental discharge or simple child access protection and have one or more weak areas of construction rendering them vulnerable to attack by unauthorized users. In fact some of these gun locks are removable with simple household tools, such as hacksaws and hammers, and accordingly do not provide a sufficient deterrent to persons who find guns with these locks. Further, they offer little cutting protection in advanced attempts to remove the lock or partially remove the gun's trigger guard to circumvent the lock.

Attempts to make other types of locks secure have met with limited success. For example, as shown in FIG. 1, deadbolt locks 10 for doors have hardened pins 11 installed parallel to the direction of the deadbolt action. In operation, when locked, the deadbolt action 12 extends and seats into a receiving cavity in the side of a door frame. If there is a space between the door and the frame exposing the deadbolt action, the hardened pins resist cutting of the deadbolt action.

Other examples also exist. Key actuated high security cylinder locks 14 with a rotating tumbler 15 actuated by a key may be made more secure by placing a number of hardened inserts 16 around the tumbler as shown in FIG. 2. A ridge 15A along the tumbler cooperatively mounts into groove 14A in the cylinder lock body. The hardened inserts 16 seat in grooves 14B. The inserts 16 are designed to deter drilling the shear line of the cylinder tumbler to disable the lock.

Conventional key lock cylinders 20 primarily used for doors may have a smooth metal ring 19 circumscribing the lock, shown in FIG. 3. The ring is generally free spinning and is generally designed to prevent the use of tools such as pipe wrenches and vice grips from "wrenching" or "spinning" the lock off its setting. The ring prevents the tools from getting a good grip on the lock cylinder.

Adapter rings 18 may also be used behind cylinder locks (also shown in FIG. 3). The adapter ring 18 is generally made of metal and is typically used when retrofitting a lock into a hole larger than the lock or to cover up mistakes during the lock installation, such as wood splinters when drilling the hole. The ring 18 therefore is generally intended to provide aesthetics only, not strength.

On conventional shackle type locks, the exposed shackle has been reinforced by adding a shackle guard which covers the shackle when the lock is closed. Another arrangement for toughening a portion of conventional shackle type locks is illustrated in FIG. 4. The lock body 21 houses a removable lock casing 22 which provides the mechanism for engaging the shackle 23 to lock it in place. The lock casing houses the key lock cylinder 22B and the lock pin housing section 22A. The lock casing is held within the lock by a small retainer screw 24, which screw is shielded by two pins 25. While the two pins 25 prevent sawing through the body and retainer screw from the direction indicated by arrow 26, by cutting upwardly from the bottom of the lock parallel to the pins 25 along the direction of arrow 27, the pins can be circumvented and ultimately the lock can be defeated.

Unfortunately, the above-described conventional lock security arrangements are mainly intended to protect property and documents and are not sufficiently robust for use with gun locks which require a high degree of reliability, as human life is at stake. Furthermore, these arrangements are designed to deter access to the objects they are securing, opposed to providing reinforcement for the material used in the construction of the object being secured. A reliable gun locking arrangement that is enhanced with simple yet reliable security deterrents would be an advancement in the gun locking art. It would further be an advantage in the art to provide a gun locking device that can be applied to a number of different types of guns and can be readily removed by an authorized user, but reliably prevents unauthorized use by people of all ages, including young children. An effective gun lock will save lives of the individuals who may tamper with a gun or the life of a person from accidental or intentional use. The present invention provides such improved firearm security arrangements.

SUMMARY OF THE INVENTION

It is therefore an object of this invention to provide firearm security arrangements that prevents access to a gun when the gun is not in use.

Another object of the invention is to provide firearm security arrangements that are adaptable to a variety of gun locks and also handguns, rifles or shotguns.

A further object of the invention is to provide firearm security arrangements that resist cutting of the gun lock and/or trigger guard.

Still another object is to provide firearm security arrangements that are resistant to tampering by children and adolescents, protecting them from injury to themselves or others.

Gun locking arrangements for preventing unauthorized use of a firearm typically include two opposed side members that are locked together on opposite sides of a trigger guard. Generally, one of the side member has a latch pin, and the other side member has a means for receiving and clasping the end portion of the latch pin to hold the side members in fixed spaced apart relationship about the trigger. In one aspect of the invention, the latch pin is adjustable inwardly and outwardly from its side member to accommodate firearms having trigger guards of different widths and shapes. More specifically, the latch pin has a threaded hole therein, which is screwed onto a threaded shaft extending from the side member, thereby allowing the latch pin to be adjusted to a desired length.

In another aspect of the invention, one or more hardened inserts are mounted into the side members, latch pin or other gun lock components to resist cutting of the gun lock by saws or the like and otherwise toughening the lock from damage due to hammering or other physical attacks. Alternatively, the two oppositely disposed side member may have a plurality of opposed pin receiving openings therein with a plurality of pins selectively placed in various pin receiving openings in the blocks which pins will resisting cutting of the gun lock apparatus. Additional pins may be added in other pin receiving openings about the trigger and trigger guard to more securely affix the lock to the gun.

The one or more hardened inserts (such as pins) may also be molded directly into the side members in one or more directions and in selected portions of the side members. The hardened inserts are preferably arranged to prevent an attack form the bottom of the side member or the exposed side opposite the gun grip.

In order to further prevent removal of or tampering with a gun lock, the invention encompasses adding a fitting plate or escutcheon plate to one or both of the side members of the lock. The fitting or escutcheon plate would be sized and shaped to cover the trigger guard preventing access to the trigger and also tampering with the trigger guard. Various positioning of these deterrent plates with respect to the side members are possible, making them an effective addition to many types of gun locks. Hardened inserts may be added to the plates to provide additional security.

A gun cable member with low profile end caps may also be added to a gun lock. The cable and end caps preferably have holes directly there-through resulting in a low profile cable. The cable is fed through the barrel or other cavity in a gun thus preventing an ammunition round from being left or inserted in the gun. The end caps are attached to the gun lock which is locked to the gun.

The invention further contemplates immobilizing lever actions for long guns by means of a J-shaped bracket that is hooked over the top of the gun and is attached to a gun lock affixed to the lever action. Alternatively, the bracket may take the form of a U-shaped member which is seated over the top of a long gun and shackled to the lever action by a conventional lock such as a padlock. In both of these embodiments, the lever action is prevented from moving downwardly.

The construction and operation of preferred embodiments of such above-described firearm security arrangements of the present invention may best be understood by reference to the following description taken in conjunction with the accompanying drawings in which like components are designated by the same reference numbers.

DESCRIPTION OF THE PREFERRED EMBODIMENTS

Figures 1, 2, 3, 4:
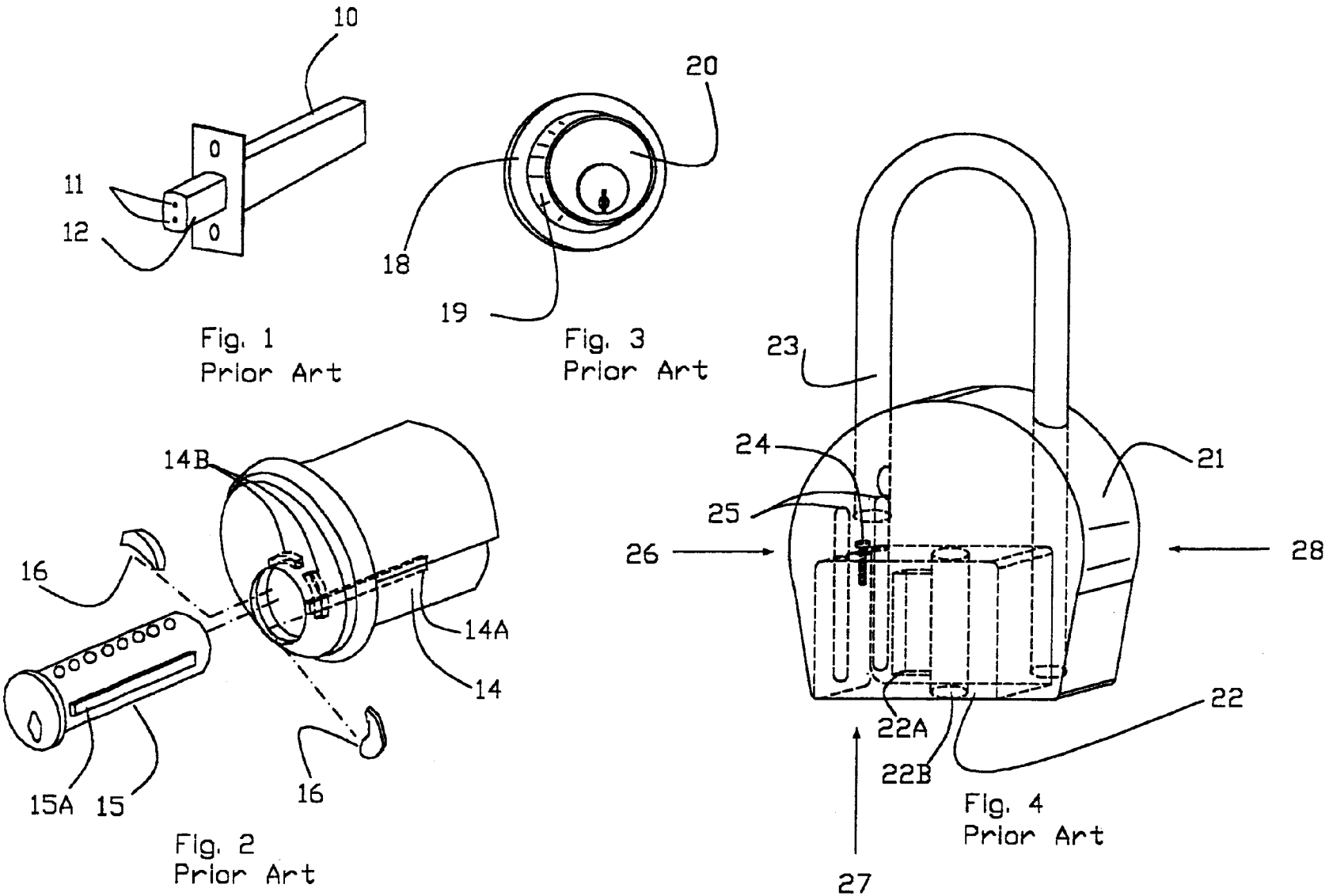
Fig. 1 Prior Art
Fig. 3 Prior Art
Fig. 2 Prior Art
Fig. 4 Prior Art
FIG. 1 is perspective view of a conventional deadbolt for doors.
FIG. 2 is perspective view of a conventional cylindrical key lock.
FIG. 3 is a perspective view of a conventional door lock.
FIG. 4 is a perspective view of a conventional shackle lock.
Figure 5:
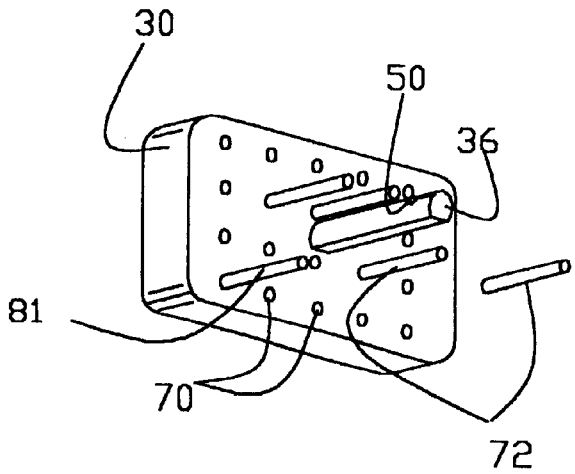
FIG. 5 is a perspective view of a gun trigger blocking structure with the two block halves or side members separated from each other with an adjustable locking post.
Figure 5:
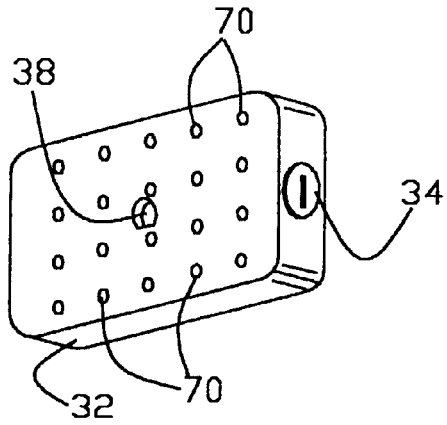
Figure 6:
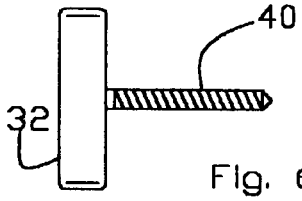
FIG. 6 is a side view of a block half showing the threaded shaft for the locking post of FIG. 5.
Figure 7:
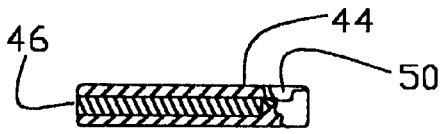
FIG. 7 is a partially broken away side view of the locking post of FIG. 5.
Figure 8:
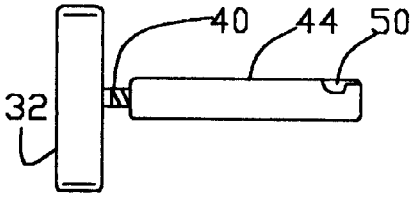
FIG. 8 is side view of the adjustable locking post threaded onto the threaded shaft.
Figure 9:
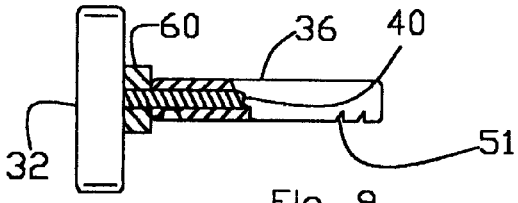
FIG. 9 is a partially broken away side view of the adjustable locking post seated against a spacer.

Referring initially to the drawings and more particularity to FIG. 5, there is shown a firearm security arrangement that includes in its principal form first and second side members or block halves 30 and 32, respectively, in pre-assembled condition. The side block halves are typically made of a metal material which is easily die cast, yet strong and durable. The second body member or side block half 32 has a conventional key lock cylinder or tumbler 34 disposed therein. A locking post 36 is mounted in the first body member or side black half 30 and received in a hole 38 in the second body member 32.

In one embodiment of the invention illustrated in FIGS. 6–9, the locking post 36 in side block 30 may comprises two parts: threaded shaft 40 which extends from side block 32 and adjustable locking post 44 which has an axial threaded blind bore 46. The adjustable locking post 44 is screwed onto the threaded shaft 40 a selected amount depending on the thickness of a particular gun guard. A cooperative latching arrangement between the tumbler 34 and the adjustable locking post may include a semi-circular groove 50 (shown in FIG. 7) which is engaged by a post 52 at the end of the tumbler 34, as shown with more particularity in assembled condition in FIG. 10. A key 56 turns the tumbler 34 to engage and disengage the post 52 with the groove 50.

The threaded shaft 40 may be a separate part which is inserted into and attached to side block half 30, or alternatively molded together with the side block as one piece. Additionally, threaded bores may extend into both ends of the adjustable locking post 44 such that it may be reversibly screwed onto the threaded shaft from either end of the post. As such, the respective ends of the adjustable locking post 44 may have different latching arrangements, such as the semi-circular groove 50 at one end and ratchet indents 51 at the other end (shown in FIG. 9) which indents cooperative with tines 53 on a tumbler locking mechanism (see for example FIG. 20). The indents may also take the form of buttress threads which extend down a portion of the locking post (see for example U.S. Pat. No. 5,437,119).

To assist in achieving the proper installation of the locking post 44, a spacer 60 may be inserted over the threaded shaft 40 and the post 44 screwed onto the threaded shaft until it seats against the spacer. Spacers 60 of different thickness can provide fixed adjustments for the adjustable locking post 44 so that the same basic lock with its side member can easily be made to suit gun guards of different widths or configurations. The locking post may also be hardened or alternatively have hardened inserts such as cross-pins, which would make the post more resistant to attack, such as by cutting.

Figure 23:
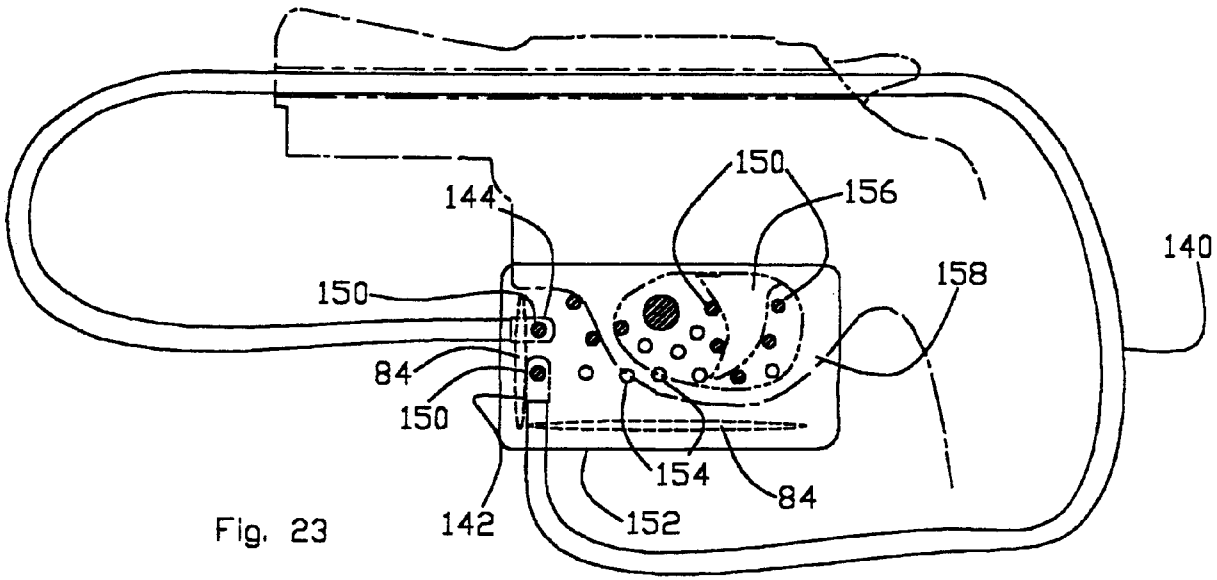
FIG. 23 is a diagrammatic view of a gun lock device secured around the trigger of a revolver (shown in phantom) with the cable illustrated in FIG. 21 inserted through the bore of the gun and secured at each end to a gun lock device.

The block halves 30, 32 may a plurality of opposed pin holes 70 for accepting pins 72 selectively positioned in the various pin holes about a gun trigger to prevent movement of the trigger and to aid in positioning the block halves relative to the trigger guard (see FIGS. 5 and 23, for example). The locking post 36 itself may also prevent movement of or access to the trigger. Advantageously, one pair of side blocks and an arranged number of pin holes with selectively placed pins can accommodate a variety of different guns with the space between the side blocks being adjustable by means of the adjustable locking post. The pins 72 themselves may have conical ends to aid in insertion into a pair of oppose pin holes 70.

Figures 10, 11, 12, 13A, 13B, 14, 14A, 14B:
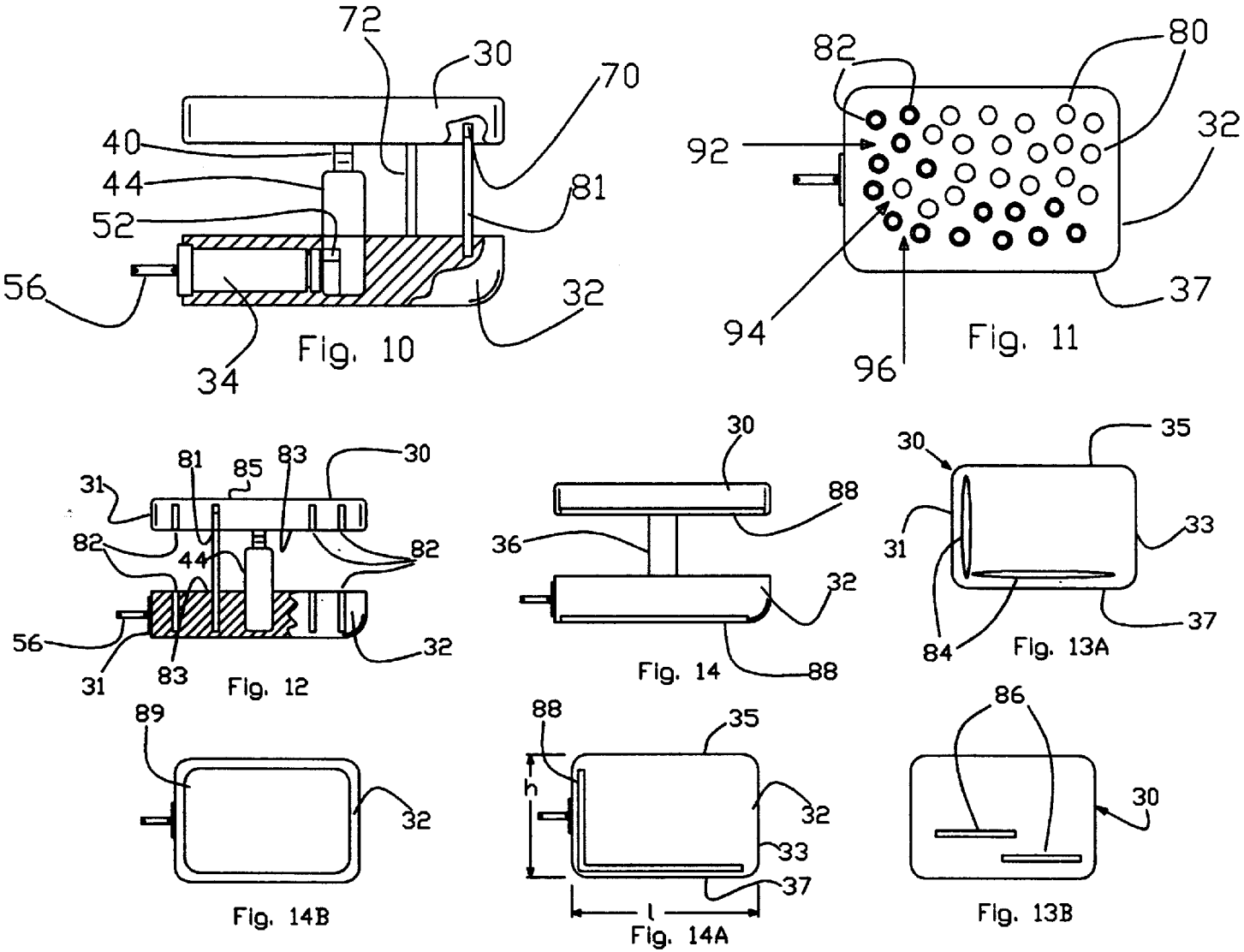
FIG. 10 is a top view of the assembled block halves showing the key lock latching tab engaging the locking post securing the adjustable latching post in the block half.
FIG. 11 is front view of a block half with attack resistant pin inserts.
FIG. 12 is a partially broken away top view showing a number of attack resistant pin inserts of FIG. 11.
FIG. 13A is a front view of a side block half showing an alternate geometry of hardened inserts.
FIG. 13B is an front view of a side block with another set of hardened inserts.
FIG. 14 is a top view of illustrating a hardened insert in the front of one of the block halves and another hardened insert in the back of the other of the block halves.
FIGS. 14A and 14B illustrate alternative embodiments of hardened inserts.

In an alternative embodiment of the invention illustrated in its various configurations in FIGS. 11–14, the block halves or side members are provided with hardened inserts or saw guards. In FIG. 11, short pins or pegs such pins 82 are inserted into holes 80 (which are not occupied by the long pins 72) in one or both of the block halves. Each of the block halves may have an array of holes 80 as shown in FIG. 11 (referred to as reference number 70 in FIG. 5). The hole array is laid out such that the pegs 82 can be selectively placed (in holes not occupied by the long pins 72) about the side member deterring attacks from different directions. For example as shown in FIG. 11, the pins 82 are placed along one side of the block half and along the bottom of the block half which deters cutting of the side member from the side, corner and bottom directions as indicated by arrows 92, 94 and 96. The pins 82 are preferably about the same length as the depth of the holes 80 and thus sit essentially flush with the inner surface 83 of the block half The pins may be slightly larger than the holes, thereby forming a press fit therebetween when the pins are pressed into the pin receiving holes 80. These features makes it difficult to remove the pins 82. Also, the pins may be glued into the holes.

Furthermore, while the pins 82 may be inserted into open holes in the block halves as described, the pins may also be molded into the blocks upon manufacture. Alternatively, the pins may be inserted into larger cavities so they are free to rotate therein. The pins would tend to rotate upon sawing, such as with a hacksaw, making the pins more difficult to cut. In either of the above-described pin arrangements, the pins can be longer extending between the two block halves into complementary holes as illustrated by pin 81 shown in FIGS. 5 and 12 to the extent that such placement is not blocked by the gun trigger or trigger guard. This would deter cutting between the block halves too.

In addition to the use of pins 82 in an alternative arrangement, elongated hardened inserts 84 may be inserted along the edges of the side block half 30 as illustrated, for example, in FIG. 13A. In this embodiment, elongated hardened inserts 84 are placed to protect adjacent side and bottom portions of the side block. Typically the key lock cylinder will be positioned on either the exposed side 31, which is opposite the gun grip (see FIG. 23 for example) or on the outside face of the side member (see FIG. 20 for example). The opposite side edge 33 and the top edge 35 or either side member, which face the barrel and grip respectively, are generally shielded to a large extent from cutting by these gun structures. Therefore, it is important that either the bottom edge 37 or the exposed side 31, or both, be toughened against cutting attacks upwardly or vertically from the bottom 37 and/or sideways or horizontally from the exposed side 31, as illustrated in FIG. 13A and FIG. 23. Hardened inserts located near the side surface and bottom surface deter sawing the trigger guard that could defeat the lock. The hardened inserts 84 are preferably elongated pins that may be hardened pins, or the pins may be made of a material which otherwise resists sawing. Preferably both side members are protected.

Alternatively, the saw guards may comprise short elongated segments 86 disposed near the bottom of the side block in a parallel fashion as shown in FIG. 13B. These inserts 86 may be also elongated pins, or other shapes, made of a hard material. Such inserts positioned along the bottom extent protect cutting the side block upwardly from the bottom.

Additionally, as shown in FIG. 14, hardened inserts or saw guards 88 may be inserted near the outside face 85 of the side member or near the inside face 83 of the side member or extend across the extent of the side block or member from the inside face 83 to the outside face 85. As shown in FIG. 14A, the saw guard 88 may be L-shaped or as shown in FIG. 14B it may take the shape of a flat plate 89. Accordingly, depending on the size, shape and construction material for the block halves, the saw guards may be selectively arranged, shaped and sized to increase the resistance of most locks to attack, particularly from sawing. The hardened inserts or saw guards, such as the examples shown herein (namely saw guards 82–89) may be molded directly into the side body member, or inserted into holes or into block cavities in the case of the flat plate 88, for example, or perhaps affixed to the side block such as by epoxy. The material for the saw guards or hardened inserts may be hardened steel or any other material that resists cutting or other disabling impact forces.

Pins, as the term is used herein, may be dowel pins or roll pins, or other elongated elements of various shapes and sizes that resist cutting and sawing, actually hardened or not. Hardened inserts as the term is used herein means elements made of a material which resists cutting which may be for example actually hardened metals or other materials that are difficult to cut or saw.

Advantageously, the saw guards prevent not only attacks to the lock itself, but also attacks on the gun itself and particularly the trigger guard thereof Conventional deterrents as described above only attempt to protect the lock itself not the object being secured.

It should be noted that the inserts 82 (used in conjunction with the long pins 72) or inserts 84 or elongated segment 86 or saw guards 88 or a combination of the above are preferably positioned to deter cutting through about 40% or more and most preferably about 75% to 80% or more of the respective length l of the bottom edge 37 in a vertical direction and/or the respective height h of the exposed side 31 in a horizontal direction to enable the lock to be removed from the trigger guard. See FIG. 14A. Preferably both side or block halves 30 and 32 are protected by the hardened members or inserts.

Figure 15:
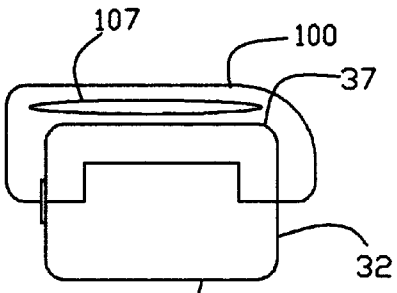
FIG. 15 is an front view of a side member with a fitting plate added to the side member to shield the trigger guard of a firearm.
Figure 17:
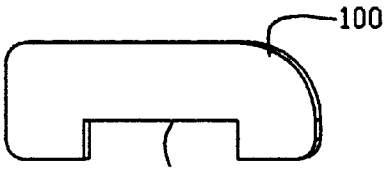
FIG. 17 is perspective view of the fitting plate in FIG. 15.
Figure 18A:
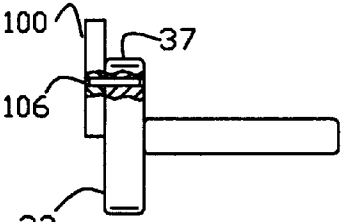
FIGS. 18A and 18B are side views of the fitting plate attached to various portions of a side member.
Figure 18B:
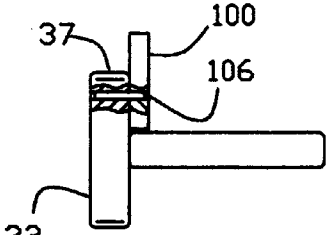
Figure 20:
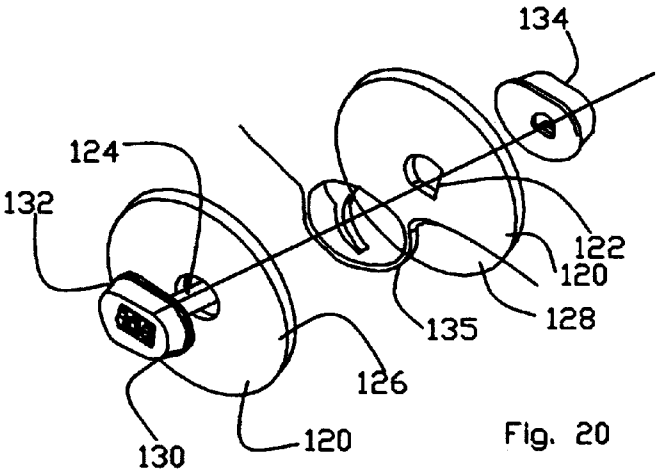
FIG. 20 is an exploded view of the two block halves of a conventional gun lock, each half with an escutcheon plate adjacently mounted therewith around a revolver trigger guard (shown in phantom)
Figure 16:
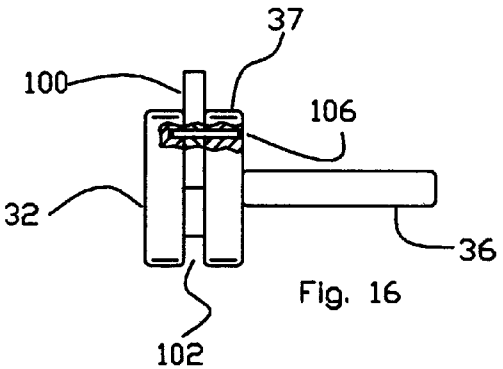
FIG. 16 is a side view of the side member shown in FIG. 15.
Figure 19:
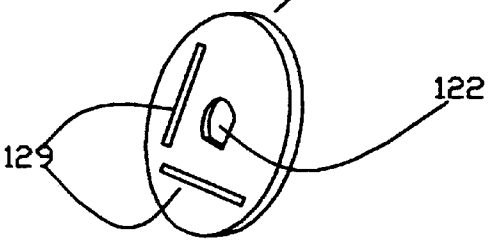
FIG. 19 is a perspective view of an escutcheon plate for use with conventional gun locks improving their resistance to tampering.

Another embodiment of the invention features a fitting plate, shown in FIGS. 15–18 and escutcheon plate shown in FIGS. 19–20, which provide further protection for gun locks. In FIGS. 15 and 16 fitting plate 100 is shown inserted into a slot 102 in one (or both) of the block halves or side members. In this particular embodiment the slot 102 in the side block 32 and the opening 104 in fitting plate 100 (shown in FIG. 17) are cooperatively sized such that when mated, the fitting plate 100 seats in the slot 102 in a tight manner which deters removal of the plate. The fitting plate 100 can also be secured to the block with roll pins, dowel pins, set screws, rivets or the like (designated generally by reference number 106) to prevent removal of the fitting plate. The fitting plate 100 typically comprises a planar member that is sized and shaped, so that when the side members, with their respective fitting plates, are mounted on a gun, the fitting plate 100 (with its side member) will substantially or completely cover the trigger guard of the gun. Fitting plates of different sizes and shapes can accompany one set of side members, which fitting plates are designed to fit a variety of trigger guards.

The fitting plate 100 can be attached to different portions of the side members such as on the exterior face of the side member as shown in FIG. 18A or on the interior face of the side member as shown in FIG. 18B. Rivets, pins, screws 106 may be used to secure such fitting plates to a side member. The fitting plates may be made of hardened steel or other materials that include hardened inserts 107 (shown in FIG. 15) to resist tampering with the trigger guard, such as by sawing.

The escutcheon plate 120, shown with more particularity in FIG. 19, comprises a ring or oblong shaped planar member, with a hole 122 there-through to receive a conventional locking post 124 or similar latching mechanism of a gun lock side member. Escutcheon plates 120 may be used on one or both sides of a gun guard. Typically, the outer diameter or extent of the escutcheon plate is larger than its associated side block member, but also the front and the rear plates 126, 128 may be different shapes and sizes to cover a gun guard (see FIG. 20). A conventional gun lock 130 as shown in FIG. 20 may have a front escutcheon plate 126 inserted over the latching post 124 of the lock's front member 132 and a rear escutcheon plate 128 placed adjacent the rear member 134, with the trigger and trigger guard 135 sandwiched there-between. The escutcheon plate member 120 can be made of hardened steel or another material containing hardened inserts. The escutcheon plate 120 may be made thick enough to resist cutting or other tampering, or may have hardened inserts or saw guards 129 to deter cutting from different directions.

The fitting plates and escutcheon plates provide simple and inexpensive means to add security and reliability to many conventional gun locks and trigger guards.

Figure 22:
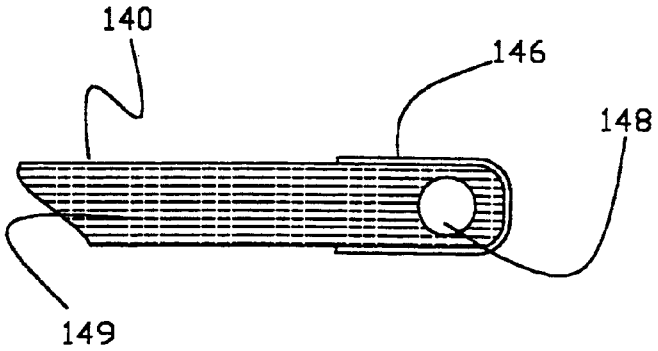
FIG. 22 is an enlarged view of one of the ends of the cable lock and its end cap.
Figure 21:
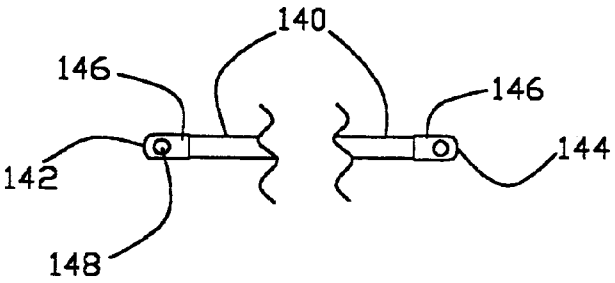
FIG. 21 is a view of a gun cable lock in accordance with the principles of the invention.

An additional firearm security arrangement is illustrated in FIGS. 21–22 in the form of cable 140 having two ends 142 and 144. The ends 142, 144 of the cable 140 have low profile caps 146. The caps and the cable ends have holes 148 therethrough. More specifically, the hole 148 is cut through a portion of the cable strands 149 (rather than by separating strands) so that the outer profile of the cable remains essentially the same, as shown in FIG. 22. The end caps 146 slide over the end of the cable and are affixed thereto. This low profile end cap arrangement advantageously allows the cable 140 to be used with smaller diameter gun barrels. The cable 140 is passed through the barrel of a gun and attached to a gun trigger locking arrangement 151, as shown in FIG. 23. In this illustration, the ends 142, 144 of the cable 140 are secured to pins 150 between side members 152 (only one side member being shown in this example). The cable 140 prevents a bullet from being inserted into the barrel. It can also be used with guns utilizing a magazine clip by sliding the cable 140 through the clip receiving cavity thereby preventing a magazine clip from being inserted into the gun. The pins 150 inserted into selected pin holes 154 seat about the trigger 156 and trigger guard 158 shown in phantom, thereby securing the gun lock in place. The cable in combination with the gun lock mounted about the trigger guard provides an extra deterrent to persons tampering or stealing a gun.

Figure 24:
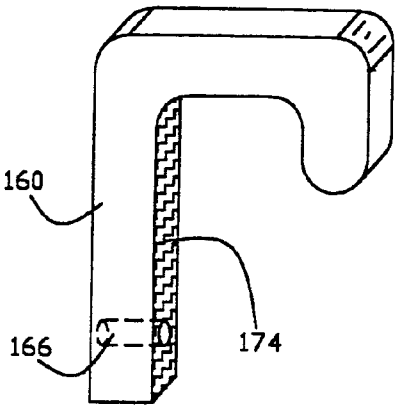
FIG. 24 is side view of a bracket for mounting on a lever action long gun.
Figure 25:
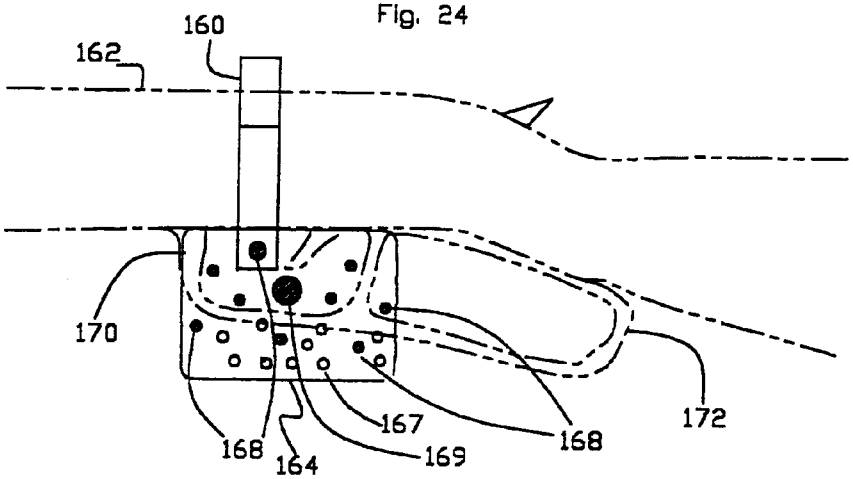
FIG. 25 is a diagrammatic view of the bracket of FIG. 24 hooked over a long gun and secured between two side members.

Securing arrangements for lever action long guns are illustrated in FIGS. 24–27. A "J" shaped bracket 160, illustrated in FIGS. 24–25, is seated over the top of a long gun 162 (shown in phantom) and secured between two side block members 164 (one side member being shown). Pin 168 disposed between the side members, passes through cross-hole 166 in the upper arm portion of the J-shaped bracket 160. An array of pins 168 inserted into selected pin holes 167 surround the trigger guard 170 and lever arm 172 to hold the lock in place. The side block members thereby attach to the lever arm of the long gun preventing downward movement or "cocking" of the lever arm 172. The inner portion of the J-shaped bracket may be lined with felt or foam 174 to prevent scratching or marring of the finish on the gun 162.

Figure 26:
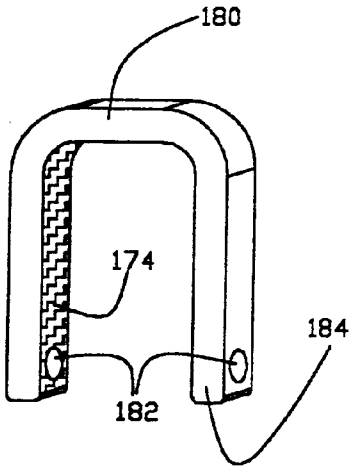
FIG. 26 is a side view of a U-shaped bracket for mounting on a lever action long gun.
Figure 27:
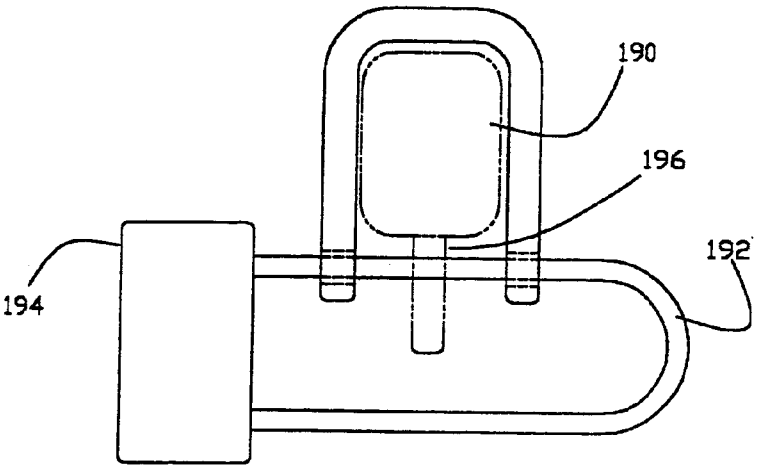
FIG. 27 is a diagrammatic view of the bracket of FIG. 26 hooked over a long gun and pad locked to secure its lever closed.

An alternative embodiment illustrated in FIGS. 26–27 comprises a "U" shaped bracket 180 with co-linear cross holes 182 in the upper opposed upper arm portions 184. The U-shaped bracket 180 is inserted over the top of a long gun 190, and the padlock shackle 192 of padlock 194 is slid through the holes 182 in the bracket and latched. The holes 182 are arranged such that the shackle arm 192 passed directly under the lever action arm 196 of the long gun effectively locking the lever action against the stock of the gun. The inner surface of the U-shaped bracket may be lined with felt or foam 174 to protect the finish of the gun.

There has thus been described a variety of firearm security arrangements. In today's environment more reliable and secure locks are needed for guns to prevent access by children or other unauthorized users. These firearm security arrangements also deter and resist physical efforts to steal a firearm. Various modifications to these firearm security arrangements will occur to persons skilled in the art without involving any departure from the spirit and scope of the invention as set forth in the appended claims.

What is claimed is:

1. A gun trigger blocking apparatus for a gun having a trigger, trigger guard and a grip, comprising:

first and second side members, adapted to be releasably mounted on opposite sides of the trigger and trigger guard, each side member having a top and bottom surface and two side surfaces, one of the side surfaces being adapted to be positioned opposite the gun grip, at least one of the side members having mounted therein at least one hardened steel member for deterring cutting from the bottom in a generally vertical direction along at least 40% of the length l of the bottom and from the exposed side in a generally horizontal direction along at least 40% of the height h of said side of the side member.

2. The gun trigger blocking apparatus defined in claim 1 wherein said at least one side member has a plurality of pin receiving holes and the at least one hardened steel member comprises a plurality of pins inserted into one or more of the plurality of pin receiving holes.

3. The gun trigger blocking apparatus defined in claim 2 wherein said at least one side member comprises both side members and wherein each side member has an outer and an inner face, the pins extending from about the inner face to adjacent the outer face of each respective side member.

4. The gun trigger blocking apparatus defined in claim 3 wherein the pins are disposed in said pin receiving holes adjacent to the bottom surface and the exposed side surface of each side member.

5. The gun trigger blocking apparatus defined in claim 4 wherein the pins are arranged to deter cutting along at least 75% of the bottom and exposed side of the side members.

6. The gun trigger blocking apparatus defined in claim 1 wherein said at least one side member comprises both side members and wherein said at least one hardened steel member is in the form of one or more elongated segments disposed within the respective side member and extending at least along the bottom and the exposed side surfaces of each respective side member.

7. The gun trigger blocking apparatus defined in claim 6 wherein the one or more elongated segments disposed in a respective side member comprises an L-shaped segment.

8. The gun trigger blocking apparatus defined in claim 6 wherein each of the one or more elongated segments disposed in a respective side member comprises two elongated segments, one of which is disposed adjacent to the bottom surface and the other one of which is disposed adjacent the exposed side surface.

9. The gun trigger blocking apparatus defined in claim 1 wherein each side member has an inner and an outer face and wherein said at least one hardened steel member includes a plate disposed between and parallel to the inner and outer faces of the side member and extends substantially to the perimeter of the side member, with the plate deterring cutting along at least 75% of the bottom and exposed side of the side member.

10. The gun trigger blocking apparatus defined in claim 9 wherein the flat plate is disposed adjacent to the outside surface of a respective side member.

11. The gun trigger blocking apparatus defined in claim 9 wherein the flat plate is disposed adjacent to the inner surface of the respective side member.

12. The gun trigger blocking apparatus defined in claim 11 wherein said at least one side member comprises both side members with a hardened steel plate disposed within each respective side member.

13. A firearm security arrangement for a gun comprising:

first and second block-shaped die cast side halves adapted to be releasably mounted on opposite sides of a trigger guard of a firearm, each side half having a side edge and an adjacent bottom edge with the side edge arranged to extend opposite the handle of the firearm; and at least one hardened steel insert embedded within each block-shaped half and extending along at least 40% of the side edge and the bottom edge thereof.

14. The firearm security arrangement defined in claim 13 wherein the at least one hardened steel insert comprises at least two inserts in each side half with one insert being embedded within the side half about the side edge and the other being embedded about the bottom edge.

15. The firearm security arrangement defined in claim 14 wherein the hardened steel inserts are disposed in a transverse direction to the side and bottom edges of each side half.

16. The firearm security arrangement defined in claim 14 wherein the hardened steel inserts are free to rotate within the block-shaped side halves.

17. An improved gun trigger blocking apparatus for substantially preventing access to a gun's trigger and trigger guard comprising:

a pair of generally rectangular side members having a length and a height and adapted to be releasably secured around the trigger and trigger guard of a gun with a lock and with the bottom of the side members being adapted to extend below the trigger guard and an exposed side of the side members being adapted to be positioned opposite the gun's grip and beyond the trigger guard;

a hardened steel member mounted in at least one side member and extending along at least 75% of the length adjacent the bottom and along at least 75% of the height adjacent to the exposed side for substantially preventing the blocking apparatus and trigger guard from being sawn through.

18. The improved gun trigger lock of claim 17 wherein said at least one side member comprises both side members and wherein said hardened steel member for substantially preventing the lock and trigger guard from being sawn through is in the form of a plate mounted in each side member.

19. The improved gun trigger lock of claim 18 wherein the plate extends to about the periphery of the respective side members.

20. The improved gun trigger lock of claim 19 wherein each side member has an outer face adapted to be positioned remote from the trigger guard and wherein the plate is mounted adjacent the outer face of each side member.

21. The improved gun trigger lock of claim 20 wherein each side member has an inner face adapted to being positioned adjacent the trigger and trigger guard and wherein the plate is mounted adjacent the inner face of each side member.

22. A gun trigger blocking apparatus for a gun having a trigger and a trigger guard comprising:

first and second side members adapted to be releasably connected together on opposite sides of the trigger and trigger guard, and covering the trigger guard, each side member having a generally rectangular shape with a bottom having a length l and an exposed side surface having a height h, at least one hardened steel member mounted within each side member and extending along at least 40% or more of the length l of the bottom and along at least 40% of the height h of the exposed side surface of the respective side member for deterring cutting from about 40% or more of the bottom in a vertical direction and the exposed side surface in a horizontal direction.

23. The gun trigger blocking apparatus of claim wherein each hardened member comprises a flat plate covering a respective side of the trigger guard for deterring cutting of the side members and the gun trigger guard.

24. The gun trigger apparatus of claims 23 wherein each side member has an inside face and wherein the flat plate member is positioned at the inside face of the respective side member.

25. The gun trigger apparatus of claim 24 wherein the flat plate mounted within each side member extends along at least 75% of the bottom and exposed side of the respective side member.

26. The gun trigger apparatus of claim 25 wherein the flat plate extends substantially across the extent of each respective side member.

* * * * *

UNITED STATES PATENT AND TRADEMARK OFFICE

CERTIFICATE OF CORRECTION

PATENT NO. : 6,457,272 B1
DATED : October 1, 2002
INVENTOR(S) : Weinraub

It is certified that error appears in the above-identified patent and that said Letters Patent is hereby corrected as shown below:

Column 12,
Line 23, after "claim" should be the number -- 22 --.

Signed and Sealed this

Fourth Day of February, 2003

JAMES E. ROGAN
*Director of the United States Patent and Trademark Office*